US006661187B1

(12) United States Patent
Park

(10) Patent No.: US 6,661,187 B1
(45) Date of Patent: Dec. 9, 2003

(54) FLY BACK TRANSFORMER

(75) Inventor: Buang Ho Park, Inchon (KR)

(73) Assignee: Samsung Electro-Mechanics Co., Ltd., Kyungki-do (KR)

( * ) Notice: Subject to any disclaimer, the term of this patent is extended or adjusted under 35 U.S.C. 154(b) by 0 days.

(21) Appl. No.: 10/230,235

(22) Filed: Aug. 29, 2002

(30) Foreign Application Priority Data

Jun. 18, 2002 (KR) ..... 2002-33899

(51) Int. Cl.[7] ..... H01J 29/70; H01F 21/02; H01F 27/28

(52) U.S. Cl. ..... 315/411; 336/145; 336/183

(58) Field of Search ..... 315/411, 399, 315/382.1; 336/145, 144, 182, 183, 220, 192, 198; 338/252, 280; H01J 29/70; H01F 21/02, 27/28

(56) References Cited

U.S. PATENT DOCUMENTS

| | | | | | |
|---|---|---|---|---|---|
| 4,414,578 | A | * | 11/1983 | Takeichi | 348/378 |
| 5,914,574 | A | * | 6/1999 | Flame et al. | 315/411 |
| 5,945,791 | A | * | 8/1999 | Haferl | 315/371 |
| 6,002,246 | A | * | 12/1999 | Gohkon et al. | 323/359 |
| 6,198,237 | B1 | * | 3/2001 | Choi | 315/411 |
| 6,232,869 | B1 | * | 5/2001 | Choi | 338/280 |
| 2003/0107462 | A1 | * | 6/2003 | Cho | 336/198 |

FOREIGN PATENT DOCUMENTS

| | | | | |
|---|---|---|---|---|
| JP | 05205946 | A * | 8/1993 | H01F/19/04 |
| JP | 09023345 | A * | 1/1997 | H04N/3/18 |

OTHER PUBLICATIONS

Korean Utility Model Laid–Open No. 89–22008—Published Nov. 3, 1989 Korean Utility Model Laid–Open No. 88–5194—Filed Apr. 11, 1988.

* cited by examiner

*Primary Examiner*—Don Wong
*Assistant Examiner*—Trinh Vo Dinh
(74) *Attorney, Agent, or Firm*—Lowe Hauptman Gilman & Berner LLP

(57) ABSTRACT

A fly back transformer comprises a horizontal output section; a low-voltage bobbin forming a first coil; a high-voltage bobbin forming a second coil having high-voltage coil layers and high-voltage rectifier diodes connected in series between upper terminal pins and lower terminal pins; a focusing pack having a PCB being printed with an adjustable resistor, and a focus input terminal; a bleeder resistor detachably fixed in position to the high-voltage bobbin and electrically connected with a high-voltage terminal of the high-voltage bobbin and the focus input terminal; and a focus-drawing wire disposed between the first and the last of the high-voltage coil layers, and having one end connected to draw a voltage generated between the high-voltage terminal and a low-voltage terminal of the high-voltage bobbin and the other end connected with the focus input terminal.

8 Claims, 7 Drawing Sheets

FLY BACK TRANSFORMER

BACKGROUND OF THE INVENTION

1. Field of the Invention

The present invention relates to a fly back transformer, and more particularly, to an improved fly back transformer capable of integrating a bleeder resistor to a high-voltage bobbin to downsize an article, reducing manufacturing cost, and readily drawing a focusing voltage during a process of winding high-voltage wires around a high-voltage bobbin so as to promptly conform with various article conditions.

2. Description of the Related Art

As well known in the art, a Fly Back Transformer (hereinafter will be referred to as FBT) is an apparatus mounted within a Braun Tube or Cathode Ray Tube (CRT) in a TV set or monitor for multiplying a pulse voltage from a horizontal output circuit for tens of times to generate a DC high voltage.

FIG. 1 shows a high-voltage stabilizing circuit in use for a general FBT. The high-voltage stabilizing circuit comprises a horizontal output circuit P receiving a horizontal synchronous pulse and generating a sawtooth wave, the first coil L1 with one end connected to an output terminal of the circuit P and the other end connected to a power source B+, the second coil L2 connected with a plurality of high-voltage rectifier diodes D1 to D5 for generating a high voltage HV, a bleeder resistor B/R stabilizing the high voltage HV from a high-voltage terminal of the second coil L2, a focusing circuit F outputting a plurality of focusing voltages and the third low-voltage circuit L3.

FIG. 2 is an exploded perspective view of a typical FBT. As shown in FIG. 2, a low-voltage bobbin 110*a* has a low-voltage wire wound around the same for plural times to constitute the first coil. A high-voltage bobbin 110 has an inner central opening into which the low-voltage bobbin 110*a* is inserted in a superposing manner. A plurality of high-voltage wires 113 are wound around the high-voltage bobbin 110 to constitute the second coil and a plurality of high-voltage rectifier diodes (hereinafter will be referred to as diodes) are connected to the high-voltage bobbin 110 in series. A focusing section 130 has a focusing pack 131 internally receiving a bleeder resistor 132. The focusing section 130 is mounted to one side of an FBT housing internally receiving the low- and high-voltage bobbins 110*a* and 110 and has a plurality of knobs for adjusting focusing voltages of a CRT. An anode cap supplies high voltage generated from a high-voltage terminal of the high-voltage bobbin 110 to the CRT through an anode cable 139.

The number of high-voltage wires 113 are wound around the high-voltage bobbin 110 of the above configured FBT 100 as follows: As shown in FIGS. 2 and 3, the first one of insulating films 114 is wound around the outer circumference of a hollow cylindrical bobbin body 111 and the first one of the high-voltage wires 113 is wound with a coil winder (not shown) around the first insulating film 114. The second one of the insulating films 114 is wound around the first wound high-voltage wire 113 and the second one of the high-voltage wires 113 is wound around the second insulating film 114. The above procedures are repeated in a radial outwardly to form a plurality of high-voltage coil layers, in which the outermost one of the insulating films 114 is wound around the outside surface of the outermost high-voltage coil layer so as to insulate the outermost high-voltage coil layer. Upon applying electric power, this configuration allows the potential difference among the wound coil layers to generate a high voltage, which is transferred through the anode cable 139 to the CRT.

In the high-voltage coil layers laminated in multiple interposing the insulating films 114 around the high-voltage bobbin 110, both ends of the high-voltage wires 113 each are alternately connected between an upper terminal pin 117 in any one of upper pin supporting portions 115 and a lower terminal pin 118 in any corresponding one of lower pin supporting portions 116. The upper pin supporting portions 115 are provided in plurality in an upper portion of the bobbin body 111, and the lower pin supporting portions 116 are provided in plurality in a lower portion of the bobbin body 111. Lead wires extended from both ends of the diodes 119 are electrically connected in series with one another.

Further, the focusing pack 131 of the focusing section 130 is internally mounted with a Printed Circuit Board (PCB) where an adjustable resistor portion is printed for adjusting the plurality of focusing voltages. The bleeder resistor 132 is electrically connected with the high-voltage terminal of the high-voltage bobbin 110 to drop the high voltage therefrom to a certain level of about 18 or 32% of the initial level, and fixedly mounted to one side of the focusing pack 131 with a holder 133.

The first pin terminal 137a and the second pin terminal 137*b* are fixedly installed in the focusing pack 131. The first pin terminal 137*a* is electrically connected with the first long pin 117*a* by inserting the first long pin 117*a* into the first pin terminal 137*a*, in which the first long pin 117*a* is an upper terminal pin of the high-voltage terminal outputting the high voltage. The second pin terminal 137*b* is electrically connected with the second long pin 117*b* by inserting the second long pin 117*b* into the second pin terminal 137*b*, in which the second long pin is another upper terminal pin disposed between the high-voltage terminal and a low-voltage terminal for drawing out the focusing voltage. The first and second pin terminals 137*a* and 137*b* are connected with the bleeder resistor 132 via cables 136*a* and 136*b*, and the high-voltage bobbin 110 is connected by its low-voltage terminal with an Automatic Brightness Limiter (ABL) circuit.

In such a conventional configuration as set forth above, however, since the focusing section 130 is necessarily provided with an additional space and holder for fixedly installing the bleeder resistor 132 in one side of the focusing pack 131, there are restrictions in downsizing the FBT 100 or reducing manufacturing cost.

Further, where the first long pin 117*b* corresponding to the first long pin 117*a* fixed in position is displaced in order to adjust the position of drawing the focusing voltage, it is needed to identically displace the second pin terminal 137*b* into which the second long pin 117*b* is correspondingly inserted. This creates a very complicated and troublesome assembly process while failing to promptly coping with various design requirements from consumers as drawbacks.

SUMMARY OF THE INVENTION

The present invention has been made to solve the conventional problems as set forth above and it is therefore an object of the present invention to provide an FBT capable of readily displacing the drawing position of focusing voltage during the operation of winding high-voltage wires around a high-voltage bobbin so as to promptly correspond to various article conditions.

It is another object of the invention to provide an FBT capable of connecting one end of a high-voltage terminal and a drawing terminal of focusing voltage to a bleeder resistor and integrating the bleeder resistor to a high-voltage bobbin. without using long pins and pin terminals so as to downsize final articles as well as reduce manufacturing cost.

According to an aspect of the invention to obtain the above objects, it is provided a fly back transformer for providing a DC high voltage and at least one focusing voltage to a CRT in a TV set or monitor, comprising: a horizontal output section for receiving horizontal synchronous pulse and generating sawtooth wave; a low-voltage bobbin having a low-voltage wire wound around the outside surface thereof to form a first coil; a high-voltage bobbin having a plurality of high-voltage wires wound for plural times interposing insulating films around the high-voltage bobbin to form a second coil having a number of high-voltage coil layers and a plurality of high-voltage rectifier diodes each connected in series between each of plural upper terminal pins and each of plural lower terminal pins; a focusing pack having a PCB internally mounted thereto by molding insulating resin, the PCB being printed with an adjustable resistor to adjust the at least one focusing voltage, and a focus input terminal for receiving the focusing voltage; a bleeder resistor detachably fixed in position to the high-voltage bobbin, and having an upper end electrically connected with one of the upper terminal pins corresponding to a high-voltage terminal to output the final high voltage generated from the high-voltage bobbin and a lower end electrically connected to the focus input terminal; and a focus-drawing wire disposed between the first one of the high-voltage coil layers and the last one of the high-voltage coil layers, and having one end connected with the upper terminal pin to draw a voltage generated between the high-voltage terminal and a low-voltage terminal of the high-voltage bobbin and the other end connected with the lower end of the bleeder resistor electrically connected with the focus input terminal of the focusing pack.

According to another aspect of the invention to obtain the above objects, fly back transformer for providing a DC high voltage and at least one focusing voltage to a CRT in a TV set or monitor, comprising: a horizontal output section for receiving horizontal synchronous pulse and generating sawtooth wave; a low-voltage bobbin having a low-voltage wire wound around the outside surface thereof- to form a first coil; a high-voltage bobbin having a plurality of high-voltage wires wound for plural times interposing insulating films around the high-voltage bobbin to form a second coil having a number of high-voltage coil layers and a plurality of high-voltage rectifier diodes each connected in series between each of plural upper terminal pins and each of plural lower terminal pins; a focusing pack having a PCB internally mounted there to by molding insulating resin, the PCB being printed with an adjustable resistor to adjust the at least one focusing voltage, and a focus input terminal for receiving the focusing voltage; a bleeder resistor detachably fixed in position to the high-voltage bobbin, and having an upper end inserted into an inserting member in an upper side of the bobbin body and a lower end inserted into a settling member in a lower side of the bobbin body, the upper end being electrically connected with one of the upper terminal pins corresponding to a high-voltage terminal and the lower end being electrically connected with the focus input terminal; and a focus-drawing wire disposed between the first one of the high-voltage coil layers and the last one of the high-voltage coil layers, and having one end connected with the upper terminal pin to draw a voltage generated between the high voltage terminal and a low-voltage terminal of the high-voltage bobbin and the other end connected with the lower end of the bleeder resistor.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENT

Hereinafter the present invention will be described in more detail.

Figure 1:
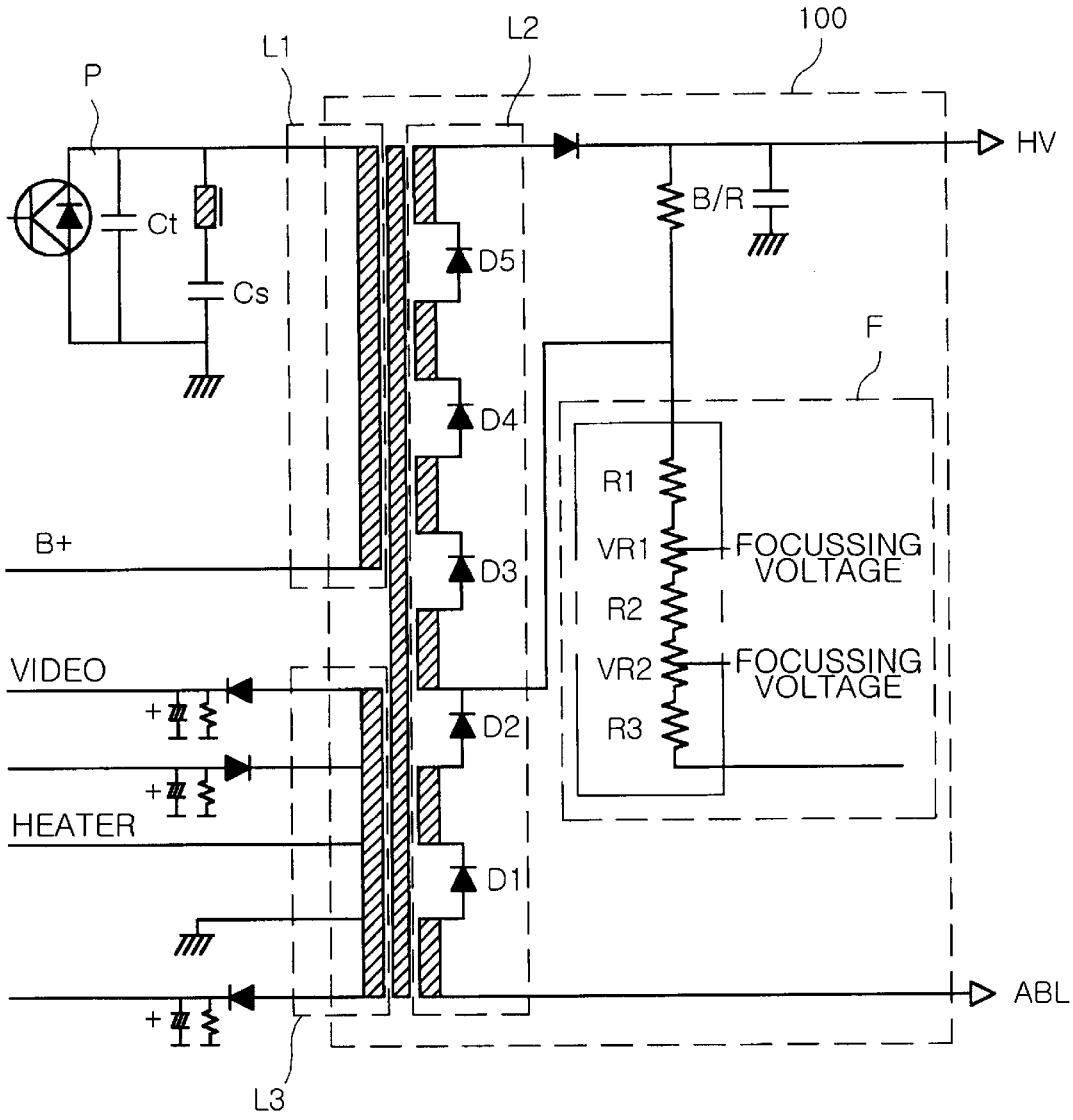
PRIOR ART FIG. 1
FIG. 1 shows a high-voltage stabilizing circuit in use for a general FBT.
Figure 2:
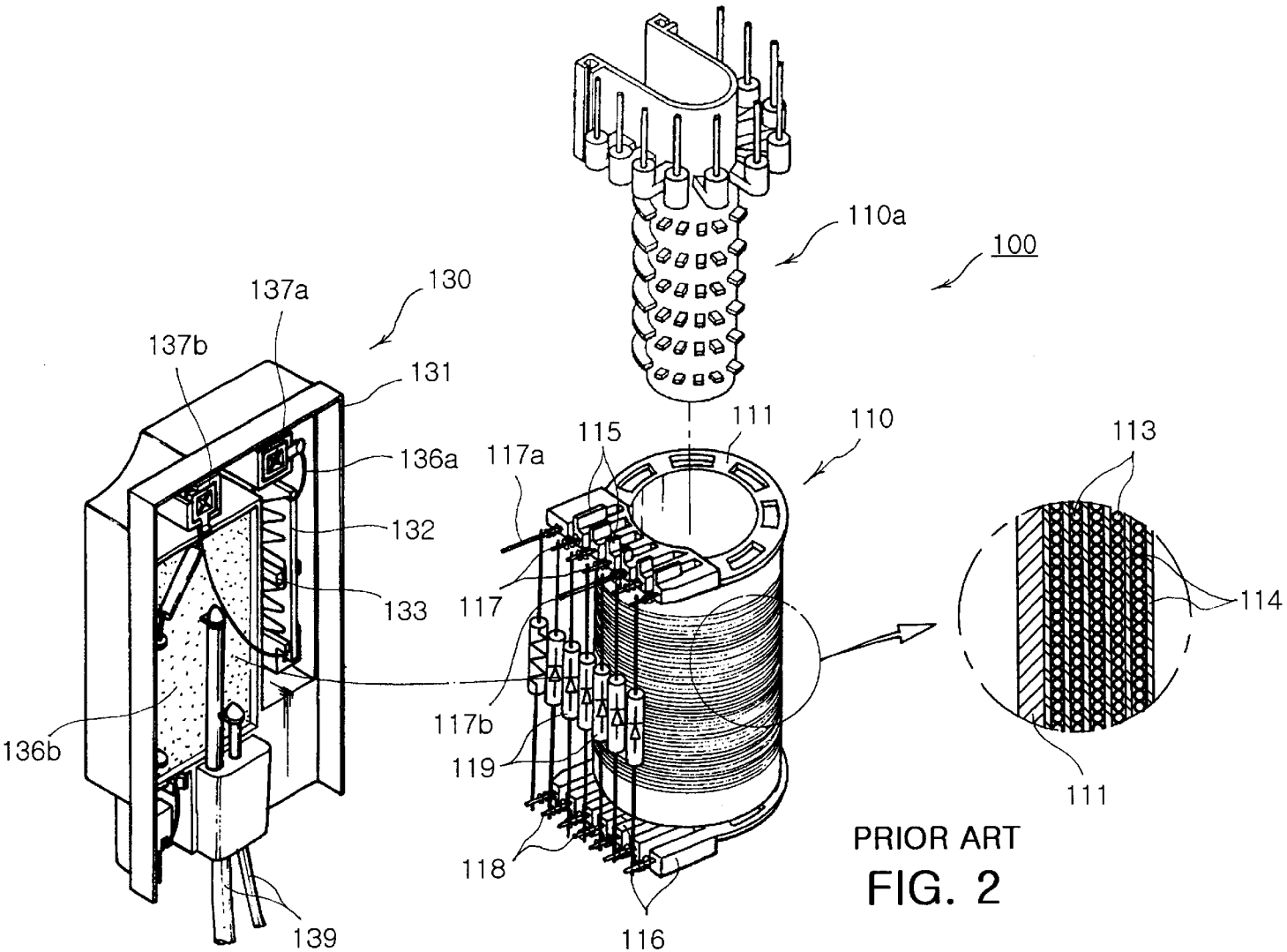
PRIOR ART FIG. 2
FIG. 2 is an exploded perspective view of a general FBT.
Figure 3:
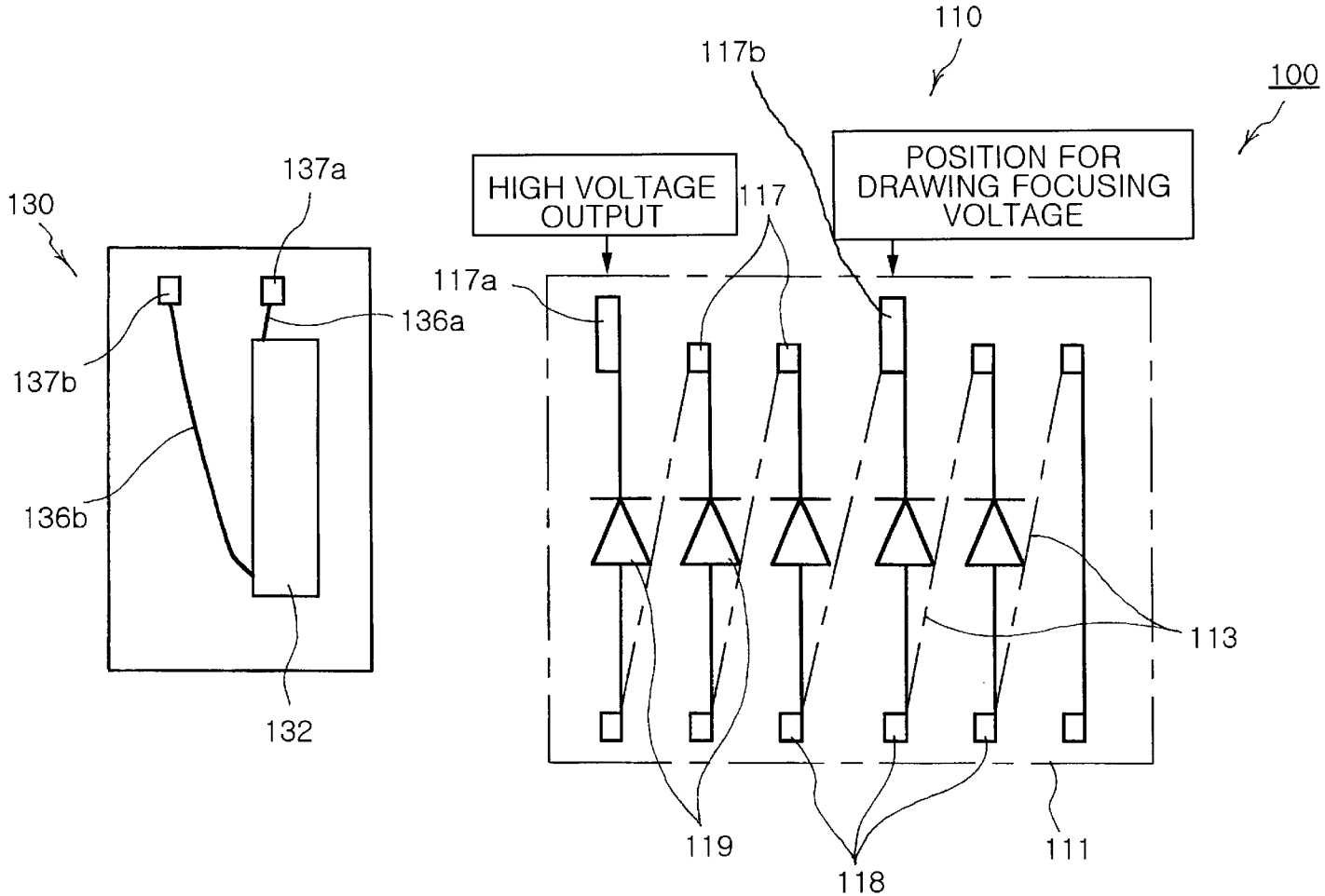
PRIOR ART FIG. 3
FIG. 3 schematically shows a bobbin section and a focusing section of a general FBT.
Figure 4:
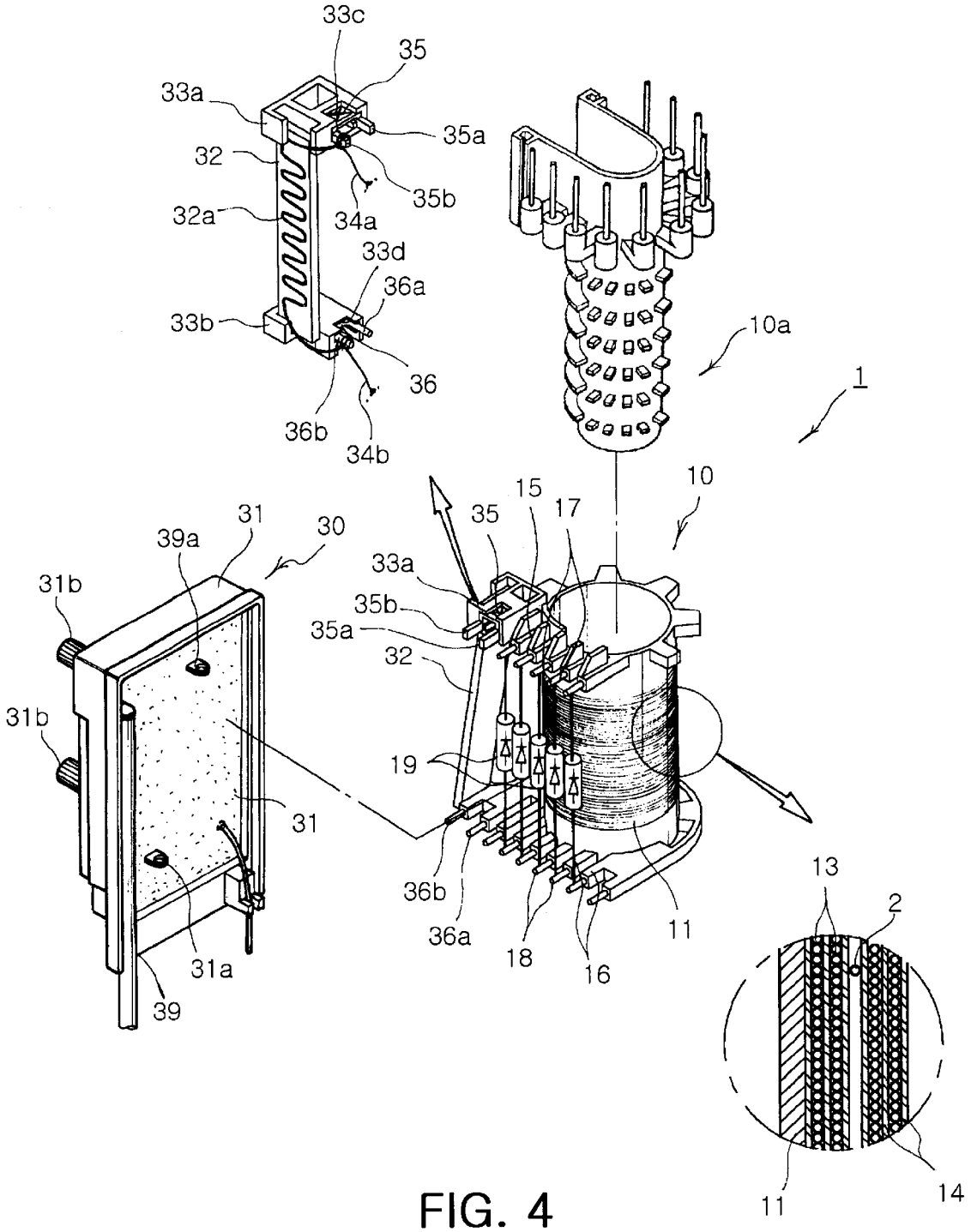
FIG. 4 is an exploded perspective view of an FBT of the invention.
Figure 5:
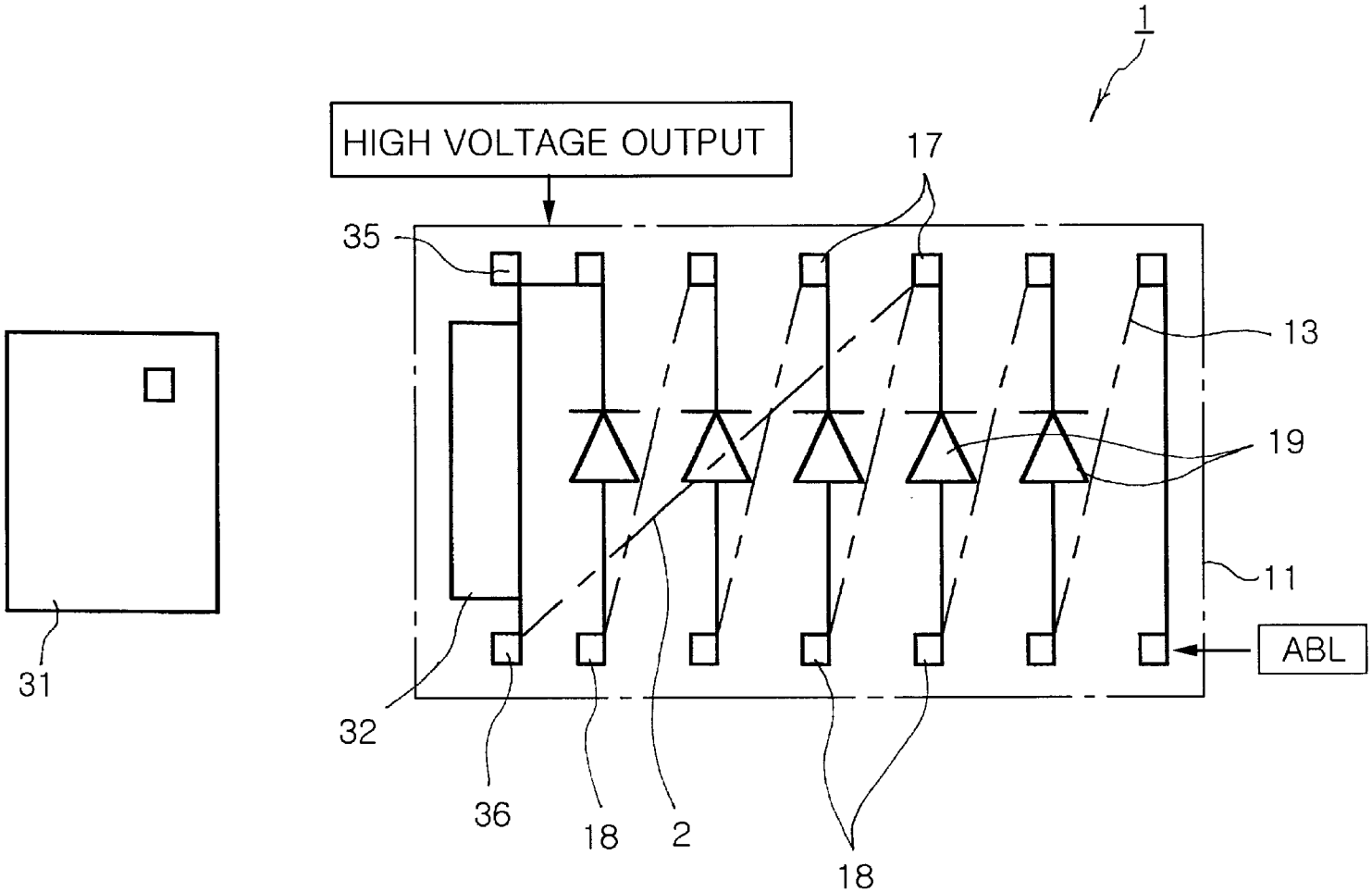
FIG. 5 schematically shows a bobbin section and a focusing section of an FBT of the invention.
Figure 6A:
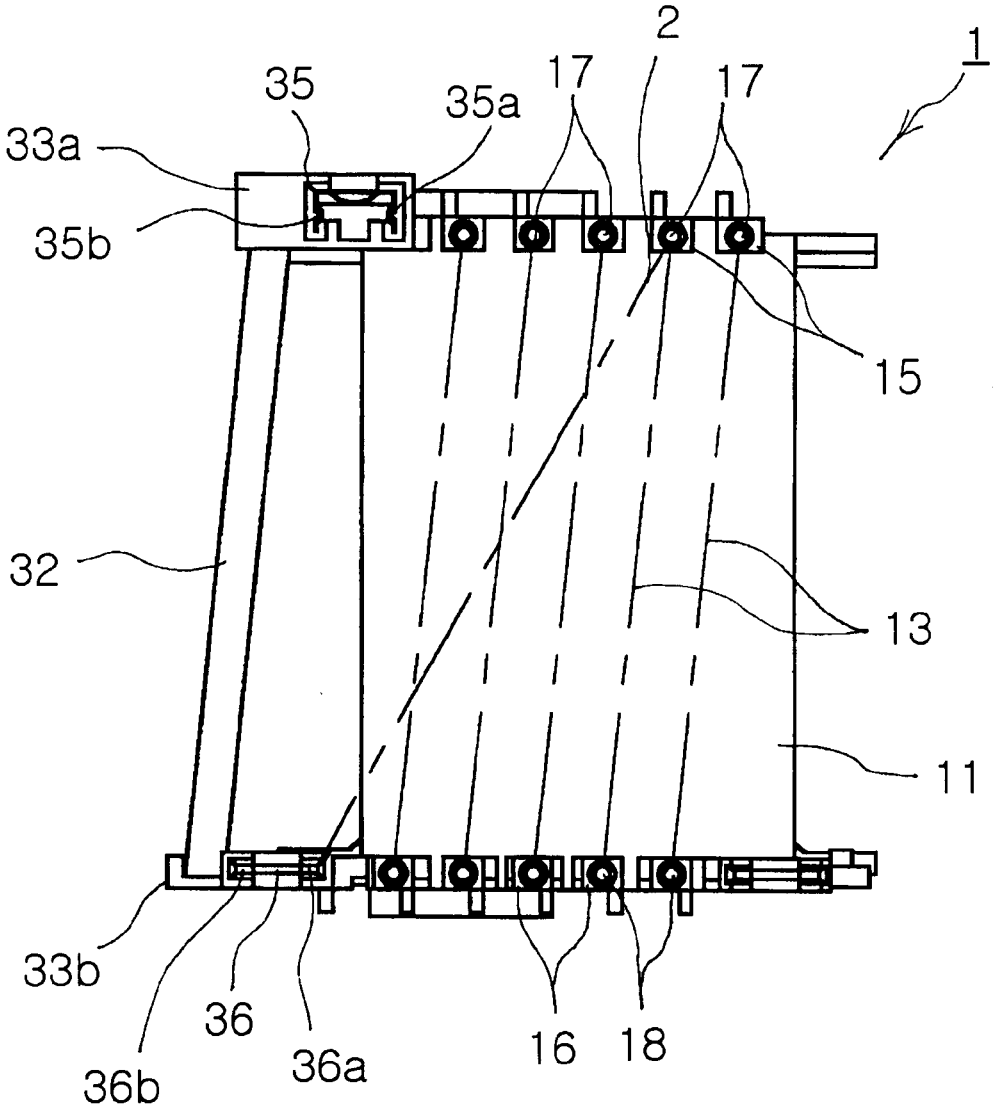
FIG. 6A shows the state of winding high-voltage wires around a high-pressure bobbin of the FBT of the invention.
Figure 6B:
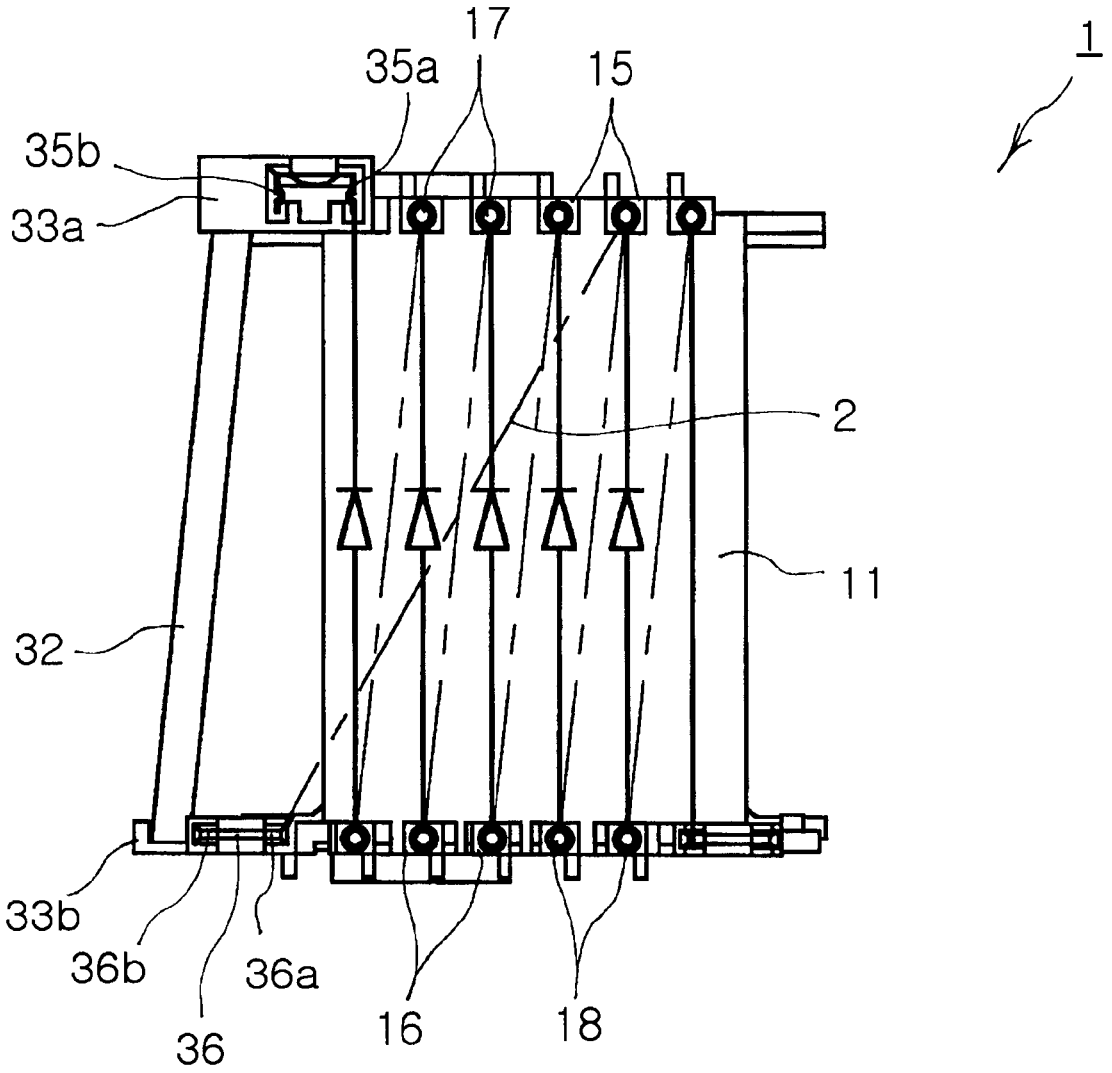
FIG. 6B shows the state of winding a focus-drawing wire around a high-pressure bobbin of the FBT of the invention.

FIG. 4 is an exploded perspective view showing a bobbin section and a focusing section in an FBT adopting a drawing method of focusing voltage according to the invention, FIG. 5 schematically shows the bobbin section and the focusing section of the FBT of the invention, and FIGS. 6A and 6B show the state of winding high-voltage wires and a focus-drawing wire around a high-pressure bobbin of the FBT of the invention.

As shown in FIGS. 4 to 6B, the FBT 1 of the invention comprises a bobbin section with a high-voltage bobbin 10 and a low-voltage bobbin 10*a* disposed in a superposing manner. Around the low-voltage bobbin 10*a*, a low-voltage wire is wound for plural times to constitute the first coil where an external power source is applied. The high-voltage bobbin 10 comprises a hollow cylindrical bobbin body 11 with an inner central opening into which the low-voltage bobbin 10*a* is inserted, and a plurality of high-voltage wires 13 are wound around the outside surface of the hollow cylindrical bobbin body 11 interposing insulating films 14 to form a plurality of coil layers thereby constituting the second coil.

The bobbin body 11 is provided with a plurality of upper pin supporting portions 15 each mounted with an upper terminal pin 17 in the upper end, a plurality of lower pin supporting portions 16 each mounted with a lower terminal pin 18 in the lower end, and diodes 19 each connected in series between the each upper terminal pin 17 and the each lower terminal pin 18.

A PCB (not shown) having an adjustable resistor portion is sealed to a focusing pack 31 defining a focusing section 30 with insulating resin to adjust the focusing voltage of a CRT.

The focusing pack 31 is provided with a plurality of knobs 31b mounted in the front, and on the other hand, a focusing connector terminal 31*a* and an anode connector terminal 39*a* each exposed from the rear for receiving the focusing voltage and a high voltage.

The bobbin body 11 of the high-voltage bobbin 10 is mounted with a bleeder resistor 32 printed with a resistor pattern 32*a* on one outside face. The bobbin body 11 is provided in an upper side with an inserting member 33*a* into which the bleeder resistor 32 is inserted by its upper end and in a lower side with a settling member 33*b* into which the bleeder resistor 32 is settled by its lower end. Adjacent to the inserting member 33*a* and the settling member 33*b*, the bobbin body 11 is provided with upper and lower pin grooves 33*c* and 33*d* which U-shaped upper and lower terminal pins 35 and 36 are respectively inserted into and fixedly disposed in.

The resistor pattern 32*a* of the bleeder resistor 32 is electrically connected by its upper end via a lead wire 34*a* with the last upper terminal pin 35 corresponding to a high-voltage terminal for outputting the high voltage generated from the high-voltage bobbin 10, and by its lower end via a lead wire 34*b* with the last lower terminal 36 corresponding to the high-voltage terminal. The last lower terminal pin 36 is electrically connected with the second end of a focus-drawing wire 2 which is connected by the first end with an intermediate one of the upper terminals 17 so as to receive the focusing voltage from the intermediate upper terminal 17 disposed between the high-voltage terminal and a low-voltage terminal in the high-voltage bobbin 10.

The focus-drawing wire 2 is disposed between the first and last high-voltage coil layers during a process of forming a plurality of high-voltage coil layers by alternately winding the high-voltage wires 13 interposing the insulating films 14 around the outside surface of the bobbin body 11 with a coil winder (not shown).

That is to say, in the process of forming the second coil by winding one of the insulating films 14 around the outside surface of the high-voltage bobbin 10 and the first one of the high-voltage wires 13 for plural times around the first insulating film 14 to form the first coil layer, winding another one of the high-voltage wires 13 for plural times around the first coil layer interposing the second insulating film 14, and repeating the above steps for plural times, the focus-drawing wire 2 is disposed according to the following process steps of: winding one of the insulating films 14 around any high-voltage coil layer predetermined for forming the focus-drawing coil layer, winding the focus-drawing wire 2 with the first end connected to the intermediate upper terminal pin 17 in one direction, soldering the second end of the focus-drawing wire 2 with the last lower terminal pin 36 connected with the lower end of the bleeder resistor 32, and electrically connecting the last lower terminal pin 36 with the focus connector terminal 31*a* to feed the drawn focus voltage to the focusing pack 31. After winding another one of the insulating films 14 around the focus-drawing wire 2 around the bobbin body 11, the remaining high-voltage coils 13 are alternately wound to complete the process of forming the second coil.

The focus-drawing wire 2 like this is connected in one-to-one correspondence with one end of the at least one intermediate upper terminal pin 17 between the last upper terminal pin 35 corresponding to the high-voltage terminal of the high-voltage bobbin 11 and the first one of the upper terminal pins 17 corresponding to the low-voltage terminal.

The focusing voltage drawn from the intermediate upper terminal pin 17 is smaller than the high-voltage generated from the high-voltage terminal 35, and increases as the position of the intermediate upper terminal pin 17 approaches the high-voltage terminal 35 from the low-voltage terminal.

Further, the focus-drawing wire 2 is preferably wound in the same direction as the high-voltage wires 13 wound around the high-voltage bobbin 11 so as to efficiently obtain the high-voltage. Also, the focus-drawing wire 2 may be wound in the shortest distance between the intermediate upper terminal pin 17 and the last lower terminal pin 36 or around the bobbin body 11 at least once.

The inserting member 33a and the settling member 33*b* of the bobbin body 11 for fixing the bleeder resistor 32 are preferably installed in the high-voltage terminal side generating the high-voltage so as to facilitate electric connection between the bleeder resistor 32 and the upper and lower terminal pins 35 and 36 in the high-voltage terminal side.

The last upper terminal pin 35 is a U-shaped pin member fixed to the upper pin groove 33*c*, and integrally has the first pin 35*a* connected with the lead wire 34*a* led out from the upper end of the resistor pattern 32*a* in the bleeder resistor 32 and the second pin 35*b* connected with one end of the last one of the diodes 19. The last lower terminal pin 36 is also a U-shaped pin member fixed to the lower pin groove 33*d*, and integrally has the first pin 36*a* connected with the lead wire 34*b* led out from the lower terminal of the resistor pattern 32*a* in the bleeder resistor 32 and the second pin 36*b* connected with one end of the focus-drawing wire 2.

The following discussion will show the operation of the invention.

In the FBT 1 of the invention, applying sawtooth wave to one end of the first coil formed in the low-voltage bobbin 10*a* and electric power to the other end thereof, the sawtooth wave applied to the first coil of the low-voltage bobbin 10*a* is stepped up by the high-voltage coil layers forming the second coil of the high-voltage bobbin 10.

At the same time, the sawtooth wave is rectified by the diodes 19 each connected in series between each of the upper terminal pins 17 and each of the lower terminal pins 18 to output a high voltage (e.g. about 25 kV) to the last upper terminal pin 35. The high voltage output is inputted into a high-voltage output terminal such as an anode cap connected to the CRT through an anode cable 39 and simultaneously toward the bleeder resistor 32 electrically connected with the last upper terminal pin 35.

The high voltage inputted to the bleeder resistor 32 is stabilized owing to voltage drop up to about 18 to 32% of the original level while passing through the resistor pattern printed in the bleeder resistor 32.

Further, the focus-drawing wire 2 is electrically connected via the insulating films 14 among the high-voltage coil layers between the lower end of the bleeder resistor 32 and the intermediate upper terminal pin 17 which is mounted between the first upper terminal pin 17 in the lower-voltage terminal side and the last upper terminal pin 35 in the high-voltage terminal side. The high-voltage is partially drawn out through- the focus-drawing wire while being stepped up as approaching from the low-voltage terminal to the high-voltage terminal, the drawn-out focusing voltage is inputted to the PCB through the focusing connector terminal 31a of the focusing pack 31, and the focusing voltage input is adjusted by the adjustable resistor portion of the PCB.

In the meantime, where it is desired to design the FBT 1 to input a higher focusing voltage to the focusing pack 31 at the consumer's request, the first end of the focus-drawing wire 2 is connected with the intermediate upper terminal pin 17 more adjacent to the high-voltage terminal during the process of winding the high-voltage wires 13 around the high-voltage bobbin 10. On the other hand, for the purpose of designing the FBT 1 to input a lower focusing voltage to the focusing pack 31, the first end of the focus-drawing wire 2 is connected with the intermediate upper terminal pin 17 more adjacent to the low-voltage terminal.

As set forth above, the invention provides the bleeder resistor to be integrally installed in the high-voltage terminal side of the high-voltage bobbin and connected by the upper end with the high-voltage output terminal and by the lower end with the focus-drawing wire for drawing out the focusing voltage so that the entire size of an FBT article can be significantly reduced to realize downsizing, reduce manufacturing cost and shorten manufacturing process as well.

Further, the invention allows the position of drawing out the focusing voltage to be simply changed during the process of winding the high-voltage wires around the high-voltage bobbin so as to promptly cope with various focusing voltage requirements from consumers thereby enhancing the productivity as an effect.

Although the invention has been shown and described with reference to the certain preferred embodiment thereof, it will be understood by those skilled in the art that various changes in form and details may be made therein without departing from the spirit and scope of the invention as defined by the appended claims.

What is claimed is:

1. A fly back transformer for providing a DC high voltage and at least one focusing voltage to a CRT in a TV set or monitor, comprising:

a horizontal output section for receiving horizontal synchronous pulse and generating sawtooth wave;

a low-voltage bobbin having a low-voltage wire wound around the outside surface thereof to form a first coil;

a high-voltage bobbin having a plurality of high-voltage wires wound for plural times interposing insulating films around said high-voltage bobbin to form a second coil having a number of high-voltage coil layers and a plurality of high-voltage rectifier diodes each connected in series between each of plural upper terminal pins and each of plural lower terminal pins;

a focusing pack having a PCB internally mounted thereto by molding insulating resin, said PCB being printed with an adjustable resistor to adjust the at least one focusing voltage, and a focus input terminal for receiving the focusing voltage;

a bleeder resistor detachably fixed in position to said high-voltage bobbin, and having an upper end electrically connected with one of said upper terminal pins corresponding to a high-voltage terminal to output the final high voltage generated from said high-voltage bobbin and a lower end electrically connected to said focus input terminal; and a focus-drawing wire disposed between the first one of said high-voltage coil layers and the last one of said high-voltage coil layers, and having one end connected with one of said upper terminal pins to draw a voltage generated between the high-voltage terminal and a low-voltage terminal of said high-voltage bobbin and the other end connected with said lower end of the bleeder resistor electrically connected with said focus input terminal of the focusing pack.

2. The fly back transformer in accordance with claim 1, wherein said focus-drawing wire is electrically connected by the one end in one-to-one relation with at least one intermediate one of said upper terminal pins which is provided between the last one of said upper terminal pins corresponding to the high-voltage terminal of said high-voltage bobbin and the first one of said upper terminal pins corresponding to the low-voltage terminal of said high-voltage bobbin.

3. The fly back transformer in accordance with claim 1, wherein said focus-drawing wire is wound in the same direction as said high-voltage wires wound around said high-voltage bobbin.

4. The fly back transformer in accordance with claim 1, wherein said focus-drawing wire is wound in the shortest distance between said intermediate upper terminal pin and the last one of said lower terminal pins.

5. The fly back transformer in accordance with claim 1, wherein said focus-drawing wire is wound around said high-voltage bobbin at least once.

6. A fly back transformer for providing a DC high voltage and at least one focusing voltage to a CRT in a TV set or monitor, comprising:

a horizontal output section for receiving horizontal synchronous pulse and generating sawtooth wave;

a low-voltage bobbin having a low-voltage wire wound around the outside surface thereof to form a first coil;

a high-voltage bobbin having a plurality of high-voltage wires wound for plural times interposing insulating films around said high-voltage bobbin to form a second coil having a number of high-voltage coil layers and a plurality of high-voltage rectifier diodes each connected in series between each of plural upper terminal pins and each of plural lower terminal pins;

a focusing pack having a PCB internally mounted thereto by molding insulating resin, said PCB being printed with an adjustable resistor to adjust the at least one focusing voltage, and a focus input terminal for receiving the focusing voltage;

a bleeder resistor detachably fixed in position to said high-voltage bobbin, and having an upper end inserted into an inserting member in an upper side of said high-voltage bobbin and a lower end inserted into a settling member in a lower side of said high-voltage bobbin, said upper end being electrically connected with one of said upper terminal pins corresponding to a high-voltage terminal and said lower end being electrically connected with said focus input terminal; and a focus-drawing wire disposed between the first one of said high-voltage coil layers and the last one of said high-voltage coil layers, and having one end connected with one of said upper terminal pins to draw a voltage generated between the high voltage terminal and a low-voltage terminal of said high-voltage bobbin and the other end connected with said lower end of the bleeder resistor.

7. The fly back transformer in accordance with claim 6, further comprising an upper pin groove adjacent to said inserting member for receiving a U-shaped upper terminal pin and a lower pin groove adjacent to said settling member for receiving a U-shaped lower terminal pin.

8. The fly back transformer in accordance with claim 6, wherein said inserting member and settling member are provided in the high-voltage terminal side to facilitate electric connection between said bleeder resistor and said upper and lower terminal pins in the high-voltage terminal side.

* * * * *